US007479050B2

(12) United States Patent
Song et al.

(10) Patent No.: US 7,479,050 B2
(45) Date of Patent: Jan. 20, 2009

(54) PLASMA DISPLAY PANEL AND METHOD FOR MANUFACTURING THE SAME

(75) Inventors: Byung-Kwan Song, Suwon-si (KR); Jong-Sang Lee, Suwon-si (KR); Cheol-Hee Moon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 720 days.

(21) Appl. No.: 10/992,354

(22) Filed: Nov. 19, 2004

(65) Prior Publication Data

US 2005/0116648 A1 Jun. 2, 2005

(30) Foreign Application Priority Data

Nov. 29, 2003 (KR) ..... 10-2003-0086104

(51) Int. Cl.
*H01J 9/00* (2006.01)

(52) U.S. Cl. ..... 445/23

(58) Field of Classification Search ..... 313/582–587; 445/23–25

See application file for complete search history.

(56) References Cited

U.S. PATENT DOCUMENTS

| | | | | |
|---|---|---|---|---|
| 4,195,892 | A | 4/1980 | Riley | |
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 6,296,539 | B1 * | 10/2001 | Awaji et al. | 445/24 |
| RE37,444 | E | 11/2001 | Kanazawa | |
| 6,630,916 | B1 | 10/2003 | Shinoda | |

(Continued)

FOREIGN PATENT DOCUMENTS

| | | |
|---|---|---|
| CN | 1271154 | 10/2000 |

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Joseph L Williams
(74) *Attorney, Agent, or Firm*—Robert E. Bushnell, Esq.

(57) ABSTRACT

A plasma display panel (PDP) and the method for manufacturing the same. A method for manufacturing a plasma display panel includes forming electrodes along one direction on a substrate, applying the dielectric paste along the other direction perpendicular to the one direction of the electrodes on the substrate, drying the dielectric paste and firing the dried dielectric paste to form a dielectric layer. Only one swath is needed for the entire dielectric layer, saving time and production costs, while providing a superior quality layer. Accordingly, since the dielectric paste is applied along the direction perpendicular to the longitudinal direction of the display electrodes, it is advantage that tack time and the number of cleaning the nozzle is reduced.

16 Claims, 5 Drawing Sheets

U.S. PATENT DOCUMENTS

| | | | | |
|---|---|---|---|---|
| 6,707,436 | B2 | 3/2004 | Setoguchi et al. | |
| 2002/0195936 | A1* | 12/2002 | Kato et al. | 313/582 |

FOREIGN PATENT DOCUMENTS

| | | |
|---|---|---|
| JP | 02-148645 | 6/1990 |
| JP | 2845183 | 10/1998 |
| JP | 2917279 | 4/1999 |
| JP | 2001-043804 | 2/2001 |
| JP | 2001-276720 | 10/2001 |
| JP | 2001-325888 | 11/2001 |
| JP | 2002-150932 | 5/2002 |
| JP | 2003-297238 | 10/2003 |

* cited by examiner

PLASMA DISPLAY PANEL AND METHOD FOR MANUFACTURING THE SAME

CLAIM OF PRIORITY

This application makes reference to, incorporates the same herein, and claims all benefits accruing under 35 U.S.C. § 119 from an application for PLASMA DISPLAY PANEL AND THE METHOD FOR MANUFACTURING THE SAME earlier filed in the Korean Intellectual Property Office on 29 Nov. 2003 and there duly assigned Serial No. 10-2003-0086104.

BACKGROUND OF THE INVENTION

1. Field of the Invention

The present invention relates to a plasma display panel (PDP) and the method for manufacturing the same. More particularly, the present invention relates to a PDP and the method for manufacturing the same in which the formation of dielectric layer is enhanced.

2. Description of the Related Art

A PDP is a display device that realizes the display of images through excitation of phosphors by plasma discharge. That is, a predetermined voltage is applied between two electrodes mounted in a discharge region of the PDP to affect plasma discharge therebetween, and ultraviolet rays generated during plasma discharge excite a phosphor layer formed in a predetermined pattern to thus form visible images.

Traditionally, in such PDPs, the dielectric layer has been formed by a screen printing method. The screen printing method includes a step for applying dielectric paste to a substrate through a screen mask covering the electrodes. With the above method, all the elements of the PDP will be formed by one printer by exchanging screen masks and pastes. In this screen printing method, a dielectric paste is applied to a squeezer and then ejected through the openings of the screen mask while a squeezer reciprocates on the screen mask thus printing a dielectric layer. The printed dielectric layer is then dried and fired.

However, in order to achieve a desired thickness for the dielectric layer, the above processes must be repeated many times. This produces a multilayered structure for the dielectric layer. This multilayer be problematical and inefficient as vapor develops between each of the dielectric layers having a negative impact on discharging characteristics while producing a dielectric layer whose thickness is difficult to control and whose thickness uniformity is poor. Also, the thickness of the dielectric layers stacked on top of each other becomes uneven thus reducing a brightness characteristic. Further, this multi layered approach can be problematical and inefficient as a mesh shape of the screen mask remains on the dielectric layer thus reducing the smoothness of the surface of the dielectric layer. Also, the screen mask will have to be replaced often because of wear of the squeezer. Therefore, what is needed is an improved and more efficient method for forming the dielectric layer in a PDP.

SUMMARY OF THE INVENTION

It is therefore an object of the present invention to provide an improved design for a PDP.

It is also an object of the present invention to provide an improved and more efficient method for making a PDP.

These and other objects can be achieved by a PDP where a dielectric layer is formed as a single layer as opposed to many layers. The dielectric layer is applied along a direction perpendicular to the direction of electrodes on the substrate. A method for manufacturing a PDP includes forming electrodes along one direction on a substrate, applying the dielectric paste along the other direction perpendicular to the one direction of electrodes on the substrate, drying and firing the dielectric paste to form a dielectric layer. The dielectric paste may be applied by an application device, the electrodes may be display electrodes.

The dielectric layer may be formed into a single layer, the dielectric layer may include a region having a thickness between 0 to about 30 μm at the periphery of the display at the start or end of the application device swath and at the side edges of the application device swath and 30 to 40 μm elsewhere.

Preferably, the dielectric material is applied to a mother substrate, the mother substrate being much larger than the individual PDPs. After application, drying and firing, the substrate can be cut into individual PDPs. By forming the PDPs this way, mass production is made even easier. Further, when cut, many of the edges of individual PDP's may not have the roll off effect regarding thickness of the dielectric layer, because the some of the edges of an individual PDP may be in the middle of a mother substrate and thus are in the middle of a swath.

The PDP manufactured by the above method includes first and second substrates facing each other, and electrodes formed in a first direction on the first substrate and in a second direction on the second substrate. A dielectric layer is applied in a direction perpendicular to the electrodes for one or both substrates. The dielectric layer is applied using only one swath of the application device. The thickness of the dielectric layer is 30 to 40 μm. Along a periphery of the PDP, at the beginning and end and sides of the swath, the thickness of the dielectric layer can be between zero and 30 μm. The portion of the PDP having a dielectric layer of a thickness less than 30 μm is the non-display area where no more than two electrodes reside. Generally, the portion of the PDP having a dielectric layer between 30 and 40 μm is the display region. The portions of the PDP where the dielectric layer is less than 30 μm is about 4 to 8 mm wide.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
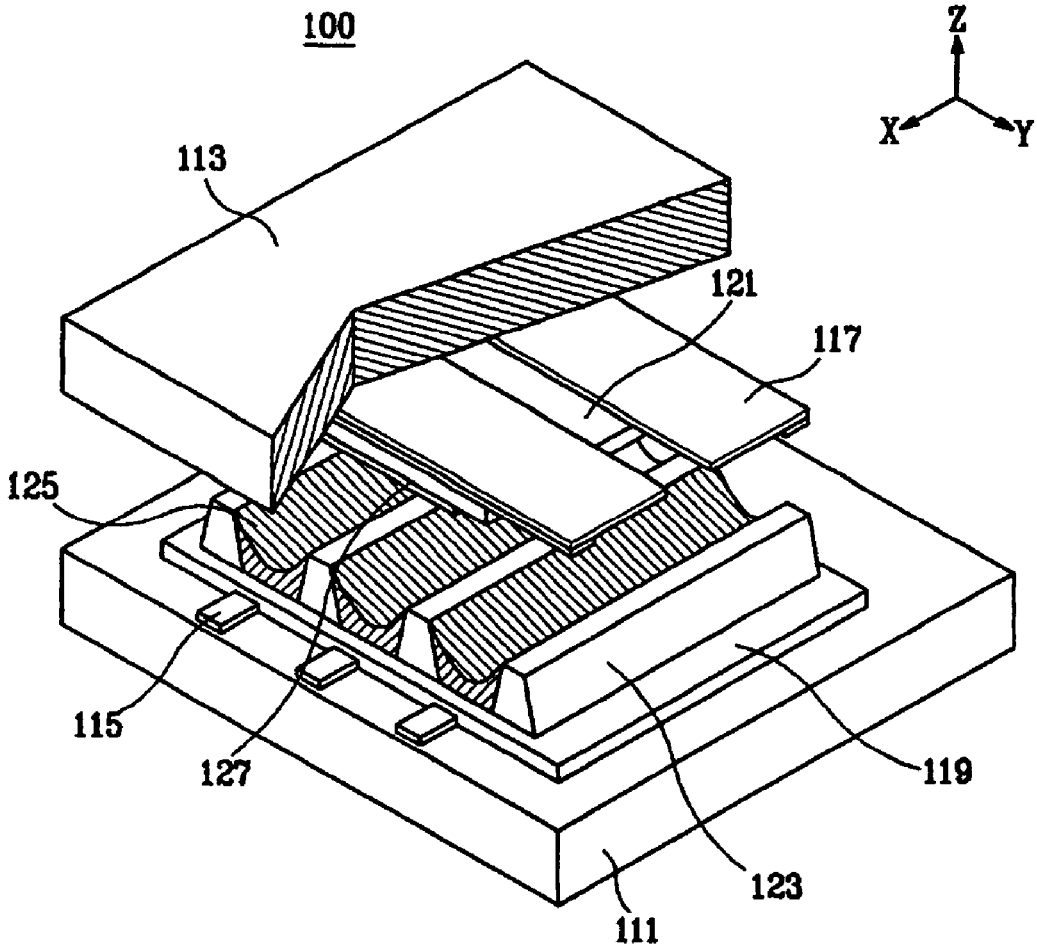
FIG. 1 is an exploded perspective view of a PDP.

Turning now to the figures, FIG. 1 is an exploded perspective view of an AC PDP 100. As illustrated in FIG. 1, the PDP 100 includes a rear substrate 111, address electrodes 115 formed on the rear substrate 111, a dielectric layer 119 formed on the rear substrate 111 and covering the address electrodes 115, a plurality of barrier ribs 123 formed on the dielectric layer 119 to create a discharge space and prevent inter-cell cross talk, and phosphor layers 125 formed on the barrier ribs 123 and on the exposed portions of the dielectric layer 119.

A plurality of display electrodes 117 are formed on a front substrate 113 in a direction perpendicular to the address electrodes 115 formed on the rear substrate 111. A dielectric layer 121 and a MgO protective layer 127 cover the display electrodes 117.

Figure 2:
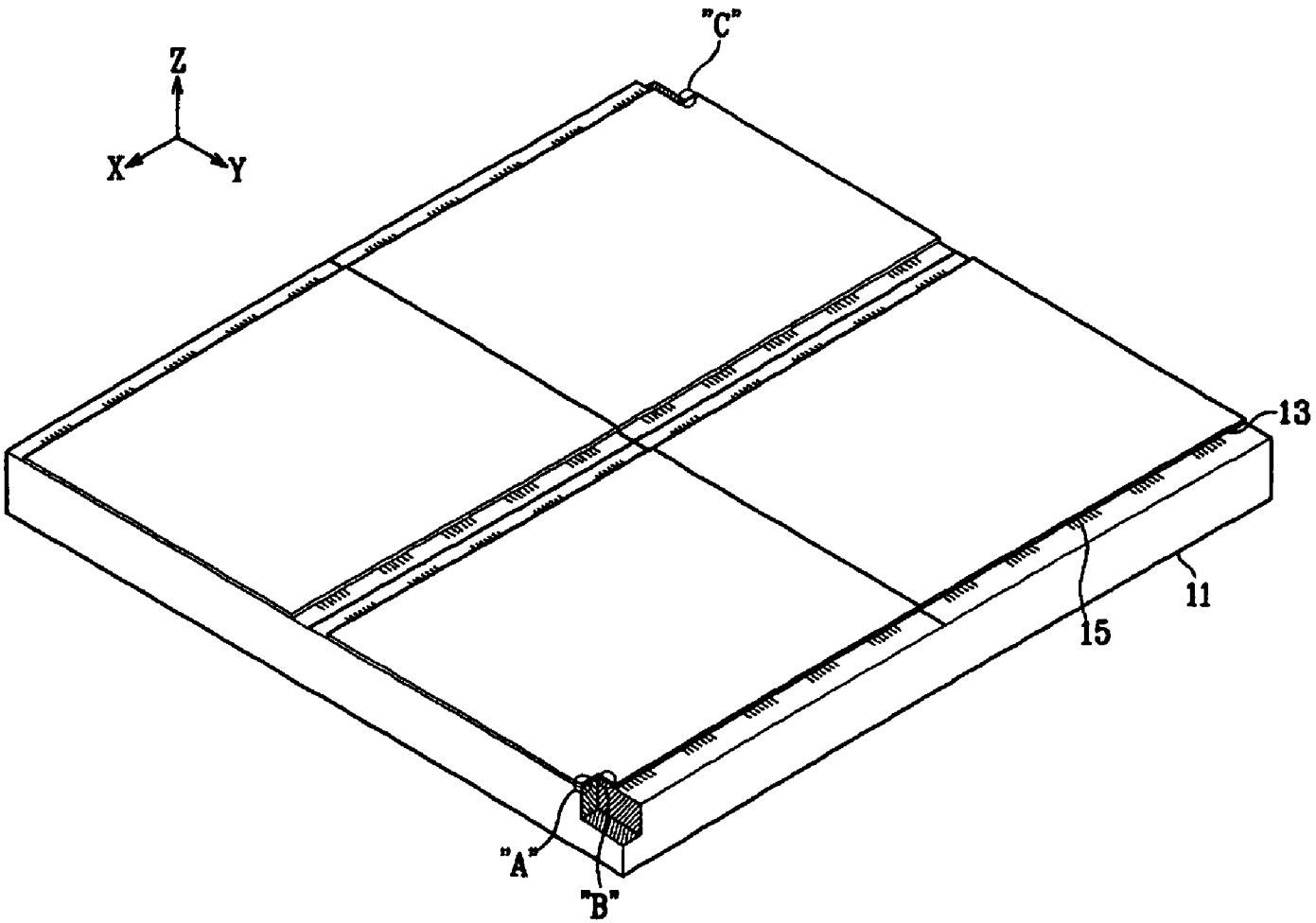
FIG. 2 is a perspective view of a mother substrate used in making a plurality of PDPs according to an embodiment of the present invention.

Turning now to FIG. 2, FIG. 2 is a perspective view of a mother substrate used to make a plurality of PDPs according to an embodiment of the present invention. In FIG. 2, mother substrate 11 is used to form 4 front substrates for 4 separate PDPs. A dielectric layer is formed on a mother substrate covering electrode previously deposited thereon. As illustrated in FIG. 2, with the PDP, a plurality of display electrodes 15 are formed on the mother substrate 11 while extending in a direction (y direction). A dielectric layer 13 is formed on the display electrodes 15 and then a MgO protective layer (not shown) is formed on the dielectric layer 13 to protect the dielectric layer 13 and increase the secondary electron emission coefficient. The mother substrate is later cut to form the front substrates for many PDPs. Although it is shown to make 4 front substrates from one mother substrate, other numbers are also conceivable and within the scope of the present invention.

Meanwhile, a rear substrate is made to face the front substrate, and a plurality of address electrodes (not illustrated in FIG. 2) are formed on the surface of the rear substrate facing the front substrate in the direction crossing the display electrodes (x direction).

Pixels are formed at the respective crossed regions of the address electrodes and the display electrodes, and collectively form a display area. The display area may be defined as an area where the display and address electrodes overlap each other. The address and the display electrodes cross each other to cause the display discharge due to the driving voltages applied to those electrodes. In other words, the display area is the region of the PDP where visible images are formed.

A plurality of barrier ribs (not shown) are formed in the display area to partition the respective pixels each with a separate discharge cell while supporting the two substrates. Phosphors are coated onto the inner wall of the discharge cells to generate visible rays.

The area external to and surrounding the display area of individual PDPs maybe defined as a "non-display area", not incurring any display discharge. Terminals for the respective electrodes are formed in the non-display area, and are connected to a driving circuit unit (not shown) via an electrical connector, such as a flexible printed circuit (FPC). The dielectric layer 13 is formed without covering the terminal portions of the display electrodes 15 allowing for efficient connectivity with an FPC (not shown).

In the PDP of the exemplary embodiment described above, application of a drive voltage is applied to the address electrodes and the display electrodes to affect address discharge therebetween, resulting in the formation of a wall charge on the dielectric layer. Further, a sustain discharge is applied to a pair of the display electrodes by an AC signal alternately supplied to the pair of the display electrodes. The sustain discharge occurs at the discharge cells selected by the address discharge. As a result, ultraviolet rays are generated while discharge gas filled in discharge spaces formed by the discharge cells is excited. The ultraviolet rays excite the phosphor layer material so that it emits visible light, thus realizing the formation of images.

In FIG. 2, four PDPs according to an embodiment of the present invention are formed on one mother substrate. Each of PDPs formed on one mother substrate is defined as a "unit", each of electrode groups is defined as an "electrode unit". Accordingly, in FIG. 3, the total number of PDP units is four, also the number of electrode units formed on the top substrate is four. As described above, when it is desired to form a plurality of PDPs from one mother substrate, it involves forming a plurality of PDP units on one mother substrate, forming entirely the dielectric layer, cutting them and then sealing each of PDP unit with the rear substrates. Therefore, the present invention is suitable for a mass production of a PDP.

The number of PDP units of FIG. 2 is only an example. Accordingly, the present invention may be applied on forming one PDP unit or a plurality of PDP units.

Figure 3:
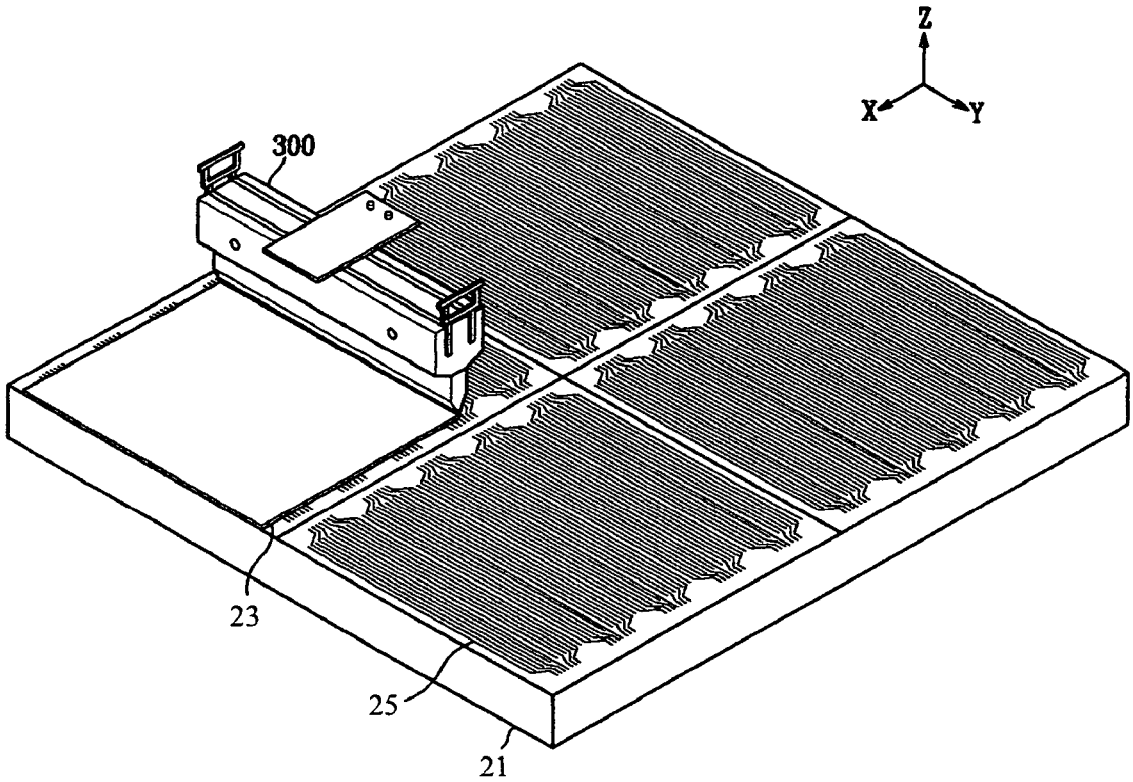
FIG. 3 is a schematic view illustrating the application process of a dielectric layer according to an embodiment of the present invention.

FIG. 3 is a schematic view illustrating the deposition process of a dielectric layer according to an embodiment of the present invention. With reference to FIG. 3, in a process of manufacturing a plurality of PDPs according to the present invention, a dielectric paste is applied to the substrates in a direction perpendicular to a longitudinal direction of display electrodes 25 to form a dielectric layer 23. At this time, the dielectric layer may be formed by using an application device 300. The application device moves in the -x direction, which is perpendicular to the y-direction that the display electrodes 25 run. The dielectric paste is applied uniformly on the substrate 21 from nozzles in the application device 300 by controlling the air pressure of the application device 300.

By having the swath of the application device 300 move in a direction that is orthogonal to and not parallel to the direction of the display electrodes, the tack time and the number of times the nozzles of the application device needs to be cleaned is reduced due to the continuous application of the dielectric paste. Also, the thickness of the dielectric layer may be formed uniformly over the entire of the substrate when the swath direction of the application device is orthogonal to the electrodes.

"Tack time" is the time taken for changing direction or changing position of the coater or application device. The tack time of the application device can be reduced by not changing often the position or direction of the application device. This reduction of tack time of the application device is achieved by having the direction of the swath of the application device perpendicular to the lengthwise direction of the electrodes on the substrate and by using a mother substrate that is very long in the swath direction.

The PDP according to an embodiment of the present invention is manufactured by a method for manufacturing as followed. This method involves first forming electrodes on the substrate (in FIG. 3, display electrodes formed on the mother substrate are illustrated, address electrodes formed on a rear substrate may be illustrated), applying a dielectric paste along a direction perpendicular to the longitudinal direction of the formed electrodes. The dielectric paste can be formed with combination of two more of the following materials: PbO, $B_2O_3$, $SiO_2$, $Al_2O_3$, BaO, or ZnO. The paste on the substrate is then dried, preferably in a heating room. Then, the dried dielectric paste is fired in a firing room at a temperature between 350° C. and 580° C. thus completing the formation of the dielectric layer on the substrate.

Accordingly, it is advantageous to form the dielectric layer as a single layer instead of as many layers stacked on top of each other. To begin with, there is better control over the thickness of the resultant dielectric layer when only one layer is present. In other words, since the result thickness of the dielectric layer may be controlled by determining an amount of the paste ejected from the application device, it is advantageous that a dielectric layer having a predetermined thickness can be formed at one time. In addition, by forming the dielectric layer from one swath of the application device, process time and process cost can be minimized. Also, the invention is suitable for forming a front substrate that requires good optical transmission characteristics. That is, the present invention can produce a dielectric layer that satisfies all the requirements for a dielectric layer on a front substrate of a PDP, such as insulating property, smoothness, high transmissivity, low vaporization and low reactivity.

Figure 4A:
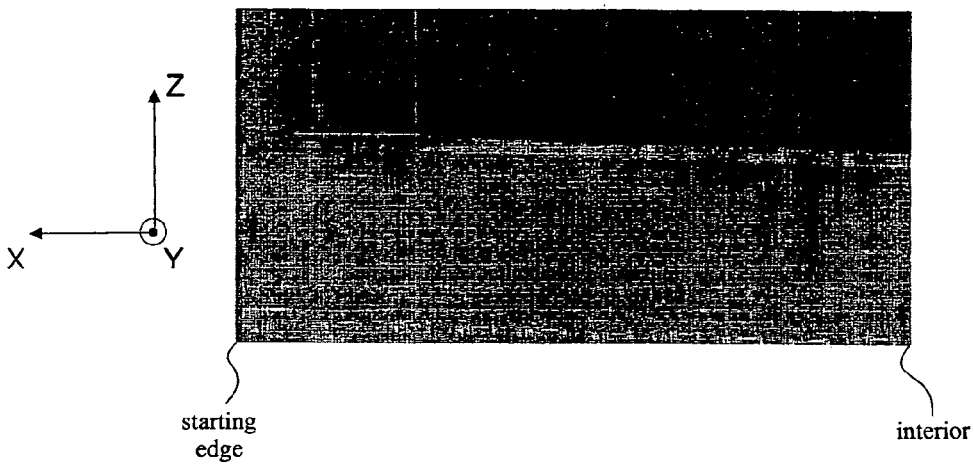
FIG. 4A is a SEM photography of portion "A" of the dielectric layer of FIG. 2.
Figure 4B:
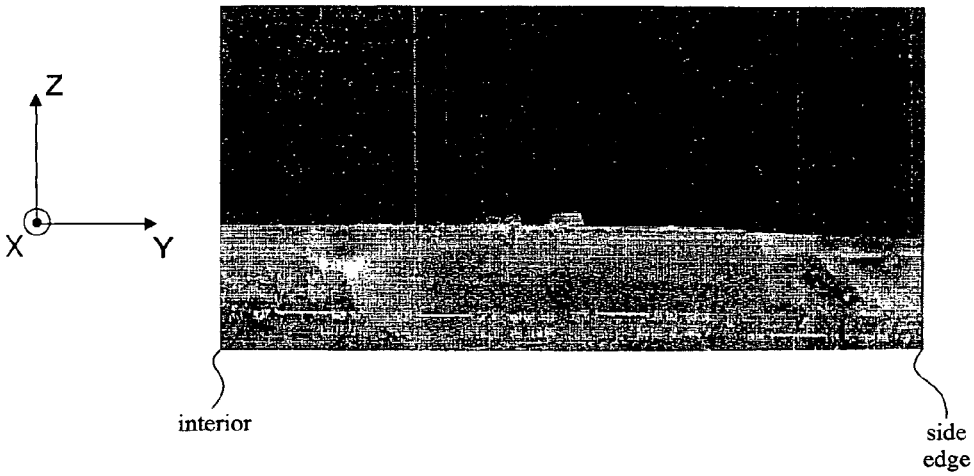
FIG. 4B is a SEM photography of portion "B" of the dielectric layer of FIG. 2.
Figure 4C:
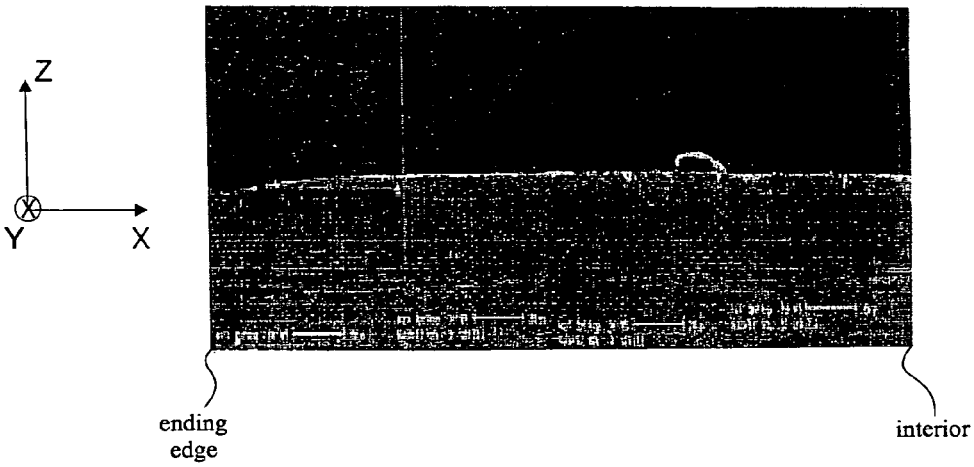
FIG. 4C is a SEM photography of portion "C" of the dielectric layer of FIG. 2.

Turning now to FIGS. 4A through 4C, FIGS. 4A and FIG. 4C illustrate SEM (scanning electron microscope) photographs of partial sectional views "A" through "C" respectively of dielectric layer 13 of FIG. 2. In more detail, FIG. 4A is a SEM photograph at "A" in FIG. 2, "A" being the dielectric layer 13 at the beginning of a swath taken in the direction of the swath. FIG. 4B is a SEM photograph at "B" in FIG. 2, "B" being at a side edge of a swath and taken in a direction parallel to display electrodes 15. FIG. 4C is an SEM photograph at "C" in FIG. 2, "C" being partial sectional view of the dielectric layer 13 at an end of a swath of the application device 300 taken in the x direction parallel to the direction the application device travels.

As shown in FIG. 4A, at first, the thickness of the dielectric layer is unstable at the left hand side of FIG. 4A, which represents the starting edge of the swath. However, the thickness becomes gradually more stable as the dielectric paste is applied from the left to right towards a center of the mother substrate, after the paste is dried and then fired. Turning now to FIG. 4B, the thickness of the dielectric layer reduces towards a right edge of the photograph, representing an edge of a swath. Turning now to FIG. 4C, the thickness of the dielectric layer has an unstable and reduced thickness at the left portion of the photograph, representing a back edge of the mother substrate where the swath of application device 300 ends. As shown in FIG. 4A through 4C, the dielectric layer 13 can be formed as a single layer with a single swath of application device 300 by application of the dielectric paste, drying and then firing. By forming dielectric layer 13 as a single layer, the thickness of the dielectric layer is controlled and uniform, thus enhancing the discharge characteristics.

Figure 5A:
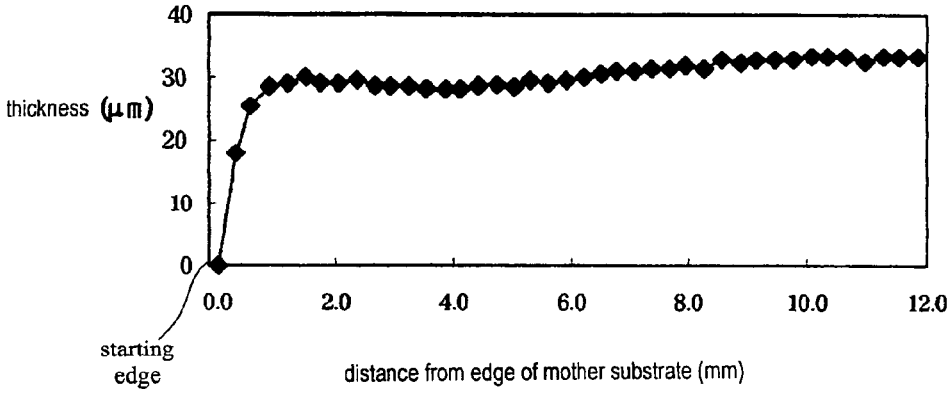
FIG. 5A is a graph illustrating a thickness profile of the dielectric layer of FIG. 4A.
Figure 5B:
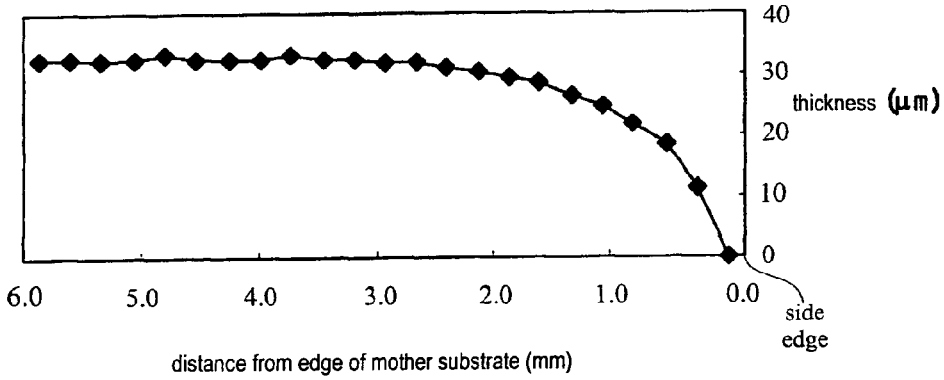
FIG. 5B is a graph illustrating a thickness profile of the dielectric layer of FIG. 4B.
Figure 5C:
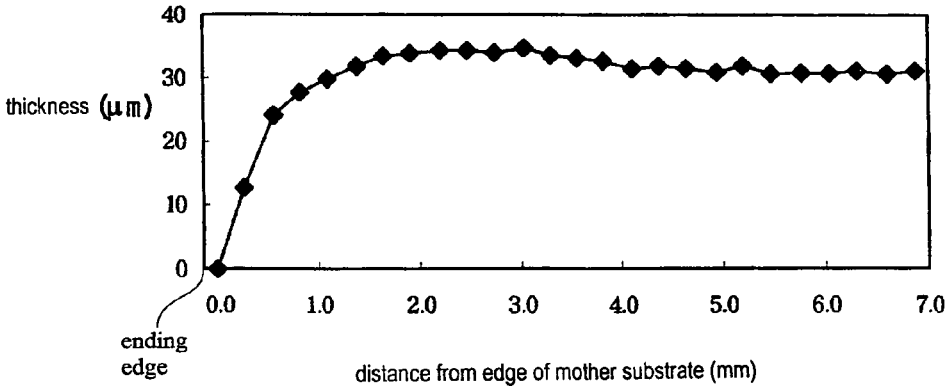
FIG. 5C is a graph illustrating a thickness profile of the dielectric layer of FIG. 4C.

Turning now to FIGS. 5A through 5C, FIGS. 5A through 5C are graphs illustrating a thickness of dielectric layer 13 at "A" through "C" respectively in FIG. 2. FIG. 5A corresponds to FIG. 4A and to "A" in FIG. 2 at a beginning edge of a swath. FIG. 5B corresponds to FIG. 4B and to "B" of FIG. 2 at a lateral edge of a swath. Likewise, FIG. 4C corresponds to FIG. 5C and to "C" of FIG. 2 at a finishing edge of a swath. FIG. 5A is a graph illustrating the thickness of the dielectric layer 13 near a starting edge of the mother substrate at "A" in FIG. 2. FIG. 5B is a graph illustrating the thickness of the dielectric layer at the side or lateral edge of a region that the application device is applying a dielectric paste at "B" in FIG. 2. FIG. 5C is a graph illustrating the thickness of the dielectric layer at an edge of the mother substrate where the swath ends at "C" in FIG. 2.

In FIG. 5A and 5C, the dielectric layer includes one region having a thickness between 0 and 30 μm at the beginning or ending point of a swath of application device 300. Since the process for forming a dielectric layer is optimized, the one region having a thickness of 0 to 30 μm of the dielectric layer is only 4 to about 8 mm wide. Since these beginning and ending regions correspond to the upper or lower end portions of the PDP substrate where the non-display area is formed, the thickness variations does not result in faulty discharge characteristics. These edges of the PDP are used for a region that frit is adhered to enhance close adhesion of upper and lower substrates.

As shown in FIG. 5A through FIG. 5C, most portions of dielectric layer 13 has a thickness between 30 and 40 μm. In a case that more than one PDP is formed from a single mother substrate, many of the edge portions of the PDP have uniform thickness dielectric layers right to the edge of the PDP, especially when an edge of the PDP is formed in the middle and not at the edge of the mother substrate.

In the PDP of the exemplary embodiment of the present invention, since the dielectric paste is applied along the direction perpendicular to the longitudinal direction of the display electrodes, it is advantageous that tack time and the number of cleaning of the nozzle is reduced due to continuous application of the dielectric paste compared to the scenario where the dielectric paste is applied in a direction that is parallel the display electrodes. Also, the thickness of the dielectric layer may be formed uniformly over the entire of the substrate.

Also, since the thickness of the dielectric layer may be controlled by varying an amount of the paste ejected from the application device, it is advantageous that a dielectric layer having a predetermined thickness can be formed at one time, resulting in a uniform thickness while reducing processing time and manufacturing costs.

Further, the invention is suitable for forming a front substrate desired to have a good optical transmission characteristics. That is, the dielectric layer 13 formed on the front substrate will have good insulating characteristics, good smoothness, a high transmissivity, low vaporization and a low reactivity, all features that a front substrate of PDP requires. Thus, the process described herein is compatible and can be used to make front substrates for PDPs. In addition, in the PDP of the exemplary embodiment of the present invention, the dielectric layer can be formed continuously at one time so that it is suitable to form a plurality of PDPs at once on one mother substrate allowing for easier mass production of PDPs. Finally, in the PDP of the exemplary embodiment of the present invention, the dielectric layer is formed into a single layer to enable the inter-structure thereof to elaborate and to prevent the vapor from generating, thus enhancing the discharge characteristics of PDP.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A method of manufacturing a plasma display panel, comprising:

forming electrodes in a first direction on a substrate;

applying a dielectric paste on the substrate in a direction perpendicular to the first direction;

drying the dielectric paste; and firing the dried dielectric paste to form a dielectric layer.

2. The method of claim 1, the dielectric paste being applied using an application device.

3. The method of claim 1, the electrodes being display electrodes.

4. The method of claim 1, the dielectric layer being produced from only a single swath of an application device and not being formed from a plurality of layers.

5. The method of claim 4, the dielectric layer being between 30 and 40 microns thick at all locations away from edges of the substrate.

6. The method of claim 1, further comprising cutting a mother substrate with the dielectric layer and the electrodes thereon for a plurality of PDPs.

7. The method of claim 1, wherein the dielectric layer includes an edge region having a dielectric layer thickness between 0 and 30 μ m.

8. The method of claim 7, the edge region being less than 8 mm wide.

9. A method of making a plurality of PDPs, comprising:

forming a plurality of electrodes in a first direction on a substrate;

applying a dielectric paste to the substrate in a direction perpendicular to the first direction by an application device and covering the plurality of electrodes, each portion of the substrate receiving only one layer of dielectric paste from only one swath of the application device;

heat treating the dielectric paste to form a dielectric layer; and cutting the substrate with the electrodes and dielectric layer thereon into a plurality of pieces, each piece being used in a different PDP.

10. The method of claim 9, each piece serving as a front substrate for a PDP, the piece being essentially transparent to visible radiation.

11. The method of claim 9, a direction of the swath of the application device being perpendicular to the first direction.

12. The method of claim 9, the heat treating comprising:

drying the dielectric paste on the substrate in a heating room; and firing the dried dielectric paste on the substrate at a temperature between 350 and 580 ° C.

13. The method of claim 9, the dielectric paste comprising a mixture of two materials selected from a, group consisting of PbO, $B_2O_3$,$SiO_2$, $A1_2O_3$,BaO and ZnO.

14. The method of claim 9, further comprising applying an MgO protective layer on top of the dielectric layer.

15. A method of making a plurality of PDPs, comprising:

forming a plurality of electrodes in a first direction on a substrate;

applying a dielectric paste to the substrate by an application device and covering the plurality of electrodes, each portion of the substrate receiving only one layer of dielectric paste from only one swath of the application device;

heat treating the dielectric paste to form a dielectric layer; and cutting the substrate with the electrodes and dielectric layer thereon into a plurality of pieces, each piece being used in a different PDP, a thickness of the dielectric layer being between 30 and 40 μm everywhere except at edges of the substrate.

16. The method of claim 15, the dielectric layer being between zero and 30 μ m thick at at least some of the edges of the substrate, the width of the portion of the dielectric layer between 0 and 30 μ m thick being about 4 mm.

* * * * *